US005150002A

United States Patent [19]

Van der Hoeck et al.

[11] Patent Number: 5,150,002

[45] Date of Patent: Sep. 22, 1992

[54] ELECTRON TUBE WITH ELECTRODE CENTERING ARRANGEMENT

[75] Inventors: Willem Van der Hoeck; Piet C. J. Van Rens; Johannes A. Rebergen, all of Eindhoven, Netherlands

[73] Assignee: U.S. Philips Corporation, New York, N.Y.

[21] Appl. No.: 304,891

[22] Filed: Jan. 30, 1989

Related U.S. Application Data

[63] Continuation of Ser. No. 647,196, Sep. 4, 1984, abandoned.

[30] Foreign Application Priority Data

Sep. 12, 1983 [NL] Netherlands ..... 8303145

[51] Int. Cl.[5] ..... H01J 19/48

[52] U.S. Cl. ..... 313/417; 313/456; 313/286

[58] Field of Search ..... 313/417, 451, 456, 481, 313/482, 267, 284, 285, 286

[56] References Cited

U.S. PATENT DOCUMENTS 2,828,433 3/1958 Frenkel ..... 313/482
2,991,390 7/1961 Shrader ..... 313/451
4,196,371 4/1980 McGrath ..... 313/482
4,368,403 1/1983 Lewis ..... 313/451

FOREIGN PATENT DOCUMENTS 2720554 11/1978 Fed. Rep. of Germany ..... 313/456
0032553 2/1982 Japan ..... 313/481

*Primary Examiner*—David K. Moore
*Attorney, Agent, or Firm*—Robert J. Kraus

[57] ABSTRACT

In an electron tube having a glass envelope portion (1) is an electrode system (3) which is slid in the envelope portion (1) and is centered with respect to the wall (7) of the envelope portion (1) by means of a number of pretensioned springs (6). The springs (6) each extend from a supporting point B, which is fixed with respect to the electrode system (3), over their effective spring length toward the wall (7) of the envelope portion (1) and press against the wall (7) at a contact point A. A stick-slip movement of the springs over the surface of the wall (7) during the sliding movement of the electrode system (3) is avoided because the springs (6) each extend over their effective spring length along a straight line between supporting point B and contact point A. Flowing of the springs and the resulting occurrence of glass damage to the wall (7) is minimized by this spring configuration.

12 Claims, 1 Drawing Sheet

ELECTRON TUBE WITH ELECTRODE CENTERING ARRANGEMENT

This is a continuation of application Ser. No. 647,196, filed Sep. 4, 1984 now abandoned.

BACKGROUND OF THE INVENTION

The invention relates to an electron tube having an electrode system centered in a tubular glass envelope portion by means of a number of metal spring elements which are connected to the electrode system. The elements each extend towards the wall of the envelope portion and press against the wall at a respective contact point.

Typical electron tubes of this type are cathode-ray tubes such as picture display tubes and camera tubes. The electrode system forms therein an electron gun for generating one or more electron beams. During manufacture of the tube, when the electrode system is inserted into the tubular envelope portion, the metal spring elements press against the glass wall of the envelope under pretension. Not infrequently damage in the form of scratches and crumbled glass particles occurs to the glass surface during sliding of the spring elements over the glass wall.

During the further manufacture of the tube such damage may lead to fracture of the glass, while the crumbled glass particles may land in places in the tube where they may seriously damage the quality of the operating tube.

SUMMARY OF THE INVENTION

It is an object of the invention to provide an electron tube in which structural measure have been taken to minimize the occurrence of glass damage during insertion of the electrode system.

According to the invention each spring element extends over its effective spring length from a supporting point which is fixed with respect to the electrode system, along a straight or substantially straight line which coincides or substantially coincides with a straight line which connects the fixed supporting point with the contact point.

"Fixed supporting point" is to be understood to mean herein a point which, for a pretensioned spring element, assumes a fixed position with respect to the electrode system. The supporting point is the point where the effective or length begins. In a mechanical sense the supporting point is the point of impact of the resultant of the forces acting on the electrode system in a radial direction via a spring element. As regards the term "contact point" it is to be noted that this is usually a point in a contact area between the spring element and the tube wall. The contact point then is a point in the contact area where the largest pressure force prevails.

The invention is based on the recognition of the fact that the above-mentioned glass damage is caused primarily by a variation of the bending moments occurring in the springs when the electrode system is inserted into the tubular envelop portion. As a result of this variation the free ends of the springs periodically impact forcefully against the glass wall. The force which is mainly responsible for the bending moments is the frictional force on the glass wall of the tube. In known spring construction the springs flex during sliding in the electrode system. During insertion the springs will first bend without the contact points between the springs and the glass wall moving over the glass surface. As soon as the insertion force overcomes the frictional force, the ends of the springs move over the glass wall in the direction of insertion. As a result of this the potential energy accumulated in the best springs is suddenly released, so that the ends of the springs press against the glass wall with a varying force, which may cause crumbling away of glass particles. This succession of events is repeated periodically as a result of which the spring moves jerkily over the glass wall (stick-slip) leaving a track of glass damage. The spring construction characterized according to the invention prevents the jerky movement because each spring extends substantially along the straight connection line between the contact point with the glass wall and the supporting point on the electrode system from which the spring extends toward the glass wall. The forces between spring and glass then includes forces which in the longitudinal direction coincide with the spring, as a result of which the spring no longer bends to flex.

In one embodiment of the invention the supporting point of a spring element coincides with a connection point of the spring element on the electrode system.

In the pretensioned condition, the part of the spring extending over the effective spring length should be as straight as possible. For that purpose, the spring in the relaxed condition should have a curvature varying according to a third degree function (also termed third degree parabola). The desired result can also be obtained to an approximation by means of at least one small bend in the spring. This bend does not disappear entirely when the spring is pretensioned, but the object of the invention is sufficiently achieved in this simple manner. That is to say, the elastic line of the spring substantially coincides with the straight connection line between the supporting point and the contact point.

The measures suggested by the invention enable both the occurrence of scratches and the crumbling away of glass to be avoided to a considerably extent. Additional measures, in particular with respect to scratch-formation formation, may include providing on the surface of the spring element making contact with the tube wall a layer of material having a lower hardness than the hardness of the material of the spring element. In this connection, a practical embodiment is characterized in that the layer consists of a copper-nickel alloy and the spring element consists of chromium-nickel steel. Another possibility is to roughen the contacting surface of the spring chemically.

BRIEF DESCRIPTION OF THE DRAWING

Embodiments of the invention will now be described in greater detail, by way of example, with reference to the accompanying drawing, in which.

DESCRIPTIONS OF THE PREFERRED EMBODIMENTS

Figure 1:
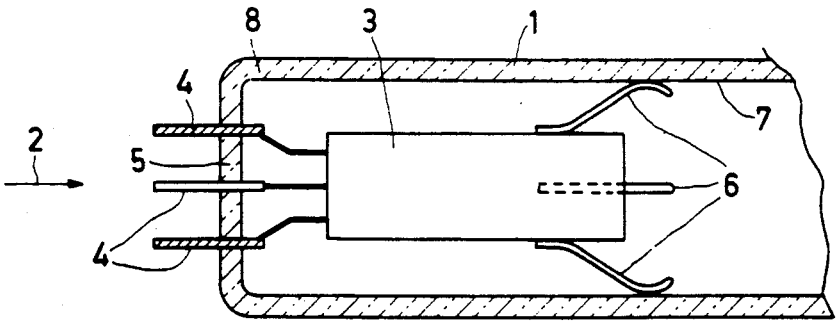
FIG. 1 is a diagrammatic longitudinal sectional view of a tubular envelope portion of an electron tube having an electrode system centered therein.

FIG. 1 shows a tubular glass envelope portion 1 of an electron tube. The said electron tube may be, for example, a picture display tube in which case the envelope portion 1 denotes the neck of the tube. A diagrammatically shown electrode system 3, mounted on a glass base 5 having electric connection pins 4, has been slid into the envelope portion in the direction of the arrow 2. The electrode system 3 comprises a number of pretensioned metal centering springs 6 which press against the wall 7 of the envelope portion. The centering springs 6 center the electrode system 3 with respect to tube wall 7 and further serve to damp microphony or other vibrations to which the electrode system may be exposed during operation of the electron tube. After the electrode system 3 has been slid into the envelope portion 1, the base 5 is sealed along its circumference with the envelope portion 1 in the location denoted by 8 in FIG. 1. During insertion of the electrode system 3, the springs 6 slide on the wall surface 7, potentially causing scratching and crumbling away of the glass.

Figure 2:
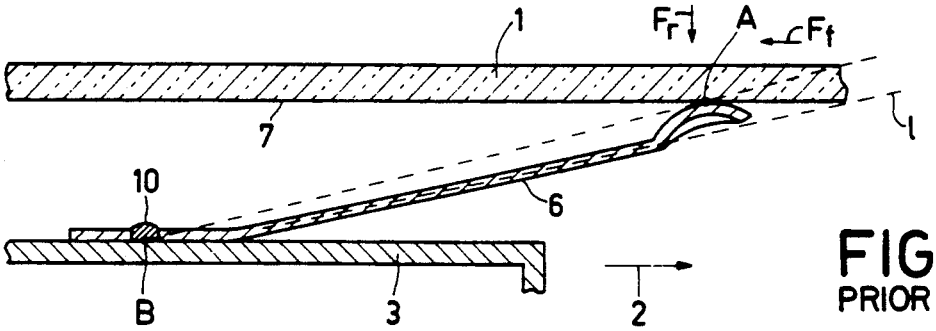
FIG.2 PRIOR ART
FIG. 2 shows a detail of a known spring construction.

The occurrence of such glass damage will be described in detail with reference to a known spring construction as shown in FIG. 2. For simplicity, corresponding components are referred to by the same reference numerals in all figures. Point A represents the contact point between the spring 6 and the wall 7. Point B represents the connection point where the spring 6 is connected to the electrode system 3 by means of a spot weld 10. The part of the spring 6 extending between the points A and B determines the effective length of the spring 6. The broken line 1 represents the elastic line of the spring, i.e. the line where the material of the spring is tension-free upon bending. When the electrode system 3 is slid into the envelope portion 1 the pretension of the spring 6 cause development of normal force $F_r$ and the frictional force $F_f$ at the point A. In the known spring construction, however, the line AB does not coincide with the line 1, as a result of which the spring is flexure-loaded by the force developed between spring and wall during the sliding movement, which force is directed along the line AB. In this manner the stick-slip movement mentioned hereinbefore occurs which may be associated with glass damage. It will be obvious that reversal of the direction of insertion 2 will not avoid stick-slip movements. In that case, as a result of the non-coincidence of the lines AB and 1, the spring 6, during the sliding movement, will still be subject to a varying bending movement.

Figure 3:
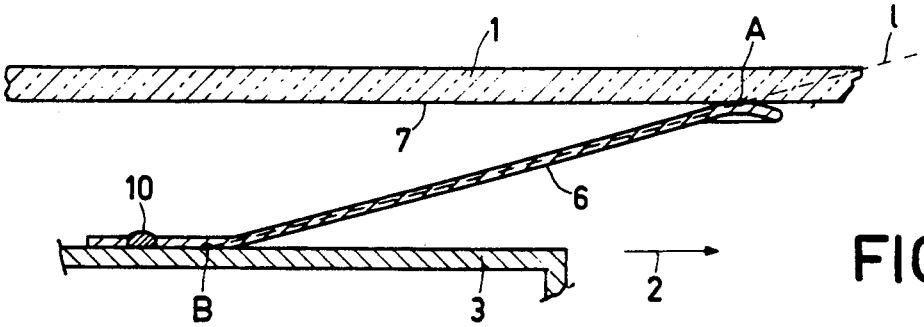
FIG. 3 shows diagrammatically a detail of a spring construction according to the invention.

FIG. 3 shows diagrammatically a spring construction according to the invention. In the assumed direction of sliding 2, the point B forms a supporting point of the spring 6 which is fixed with respect to the electrode system 3. In fact, the part of the spring 6 between the spot weld 10 and the point B does not contribute to the effective spring length. The connection line AB coincides with the elastic line 1, so that, as compared with the FIG. 2 situation, no bending moments occur here in the spring 6 but there is only a pure compression stress. This construction avoids a stick-slip movement. In the pretensioned condition the spring 6 should be as straight as possible over its effective spring length. Therefore, the spring 6, in the non-pretensioned condition, has a bent shape, according to a third degree curve. It is possible to approximate this third degree curve by providing a bend in the spring as is illustrated in FIGS. 4*a* and 4*b*.

Figure 4A:
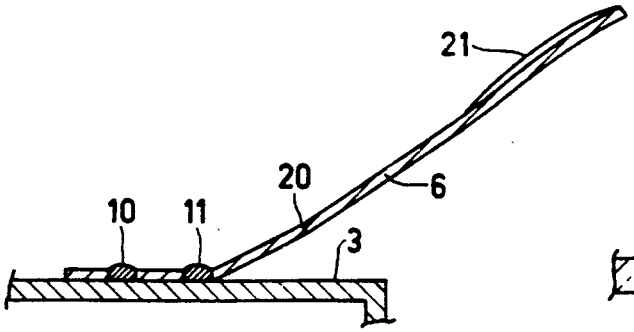
FIGS. 4*a* and 4*b* show another embodiment of a spring construction according to the invention in the untensioned and pretensioned conditions, respectively, of the spring.
Figure 4B:
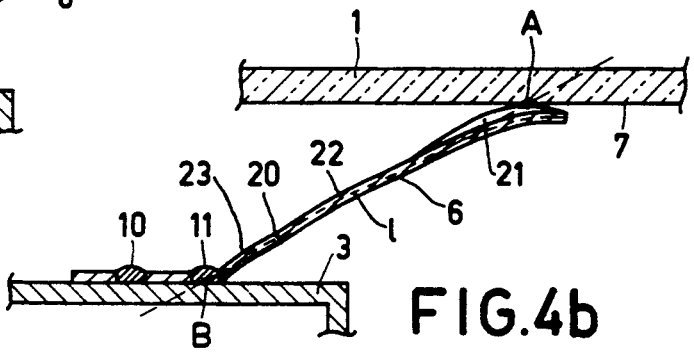

FIG. 4*a* shows the spring in the non-pretensioned condition, while FIG. 4*b* shows the spring 6 under pretension. At its free end the spring 6 has a spoon-shaped part 21, the convex surface of which presses against the wall 7. A bend 20 has been provided in the spring 6. The strength of the bend 20 depends on the desired pretension which it is desired to achieve and on the distance between the electrode system 3 and the wall 7 to be bridged by the effective spring length. Instead of one bend, several bends may be provided, thereby achieving a better approximation of the parabolic variation. FIG. 4*b* shows that in the pretensioned condition the spring has arcuate parts 22 and 23 on each side of the bend 20. The elastic line 1 in these parts 22 and 23 also extends in the form of an arc. In some places the elastic line 1 will be above and in other places it will be below the connection line AB. This may be indicated by positive and negative deviations, respectively, of the elastic line 1 with respect to the line AB. The spring element is connected to the electrode system 3 by means of spot welds 10 and 11, the spot weld 11 coinciding with the supporting point B. The spoon-shaped part 21 is a comparatively rigid part of the spring. In order to keep the Hertzian stresses in the glass as low as possible, the radius of the convex surface of the part 21 should be as large as possible. This convex surface may be coated with a layer of soft material such as a copper-nickel alloy or graphite. This further reduced the possibility of the occurrence of glass damage. Chemical roughening of the contact surface of the spring results in reduced glass damage.

The invention can be applied in all electron tubes in which an electrode system having centering springs is to be inserted into a tubular glass envelope portion. This applies especially to camera tubes and picture display tubes.

What is claimed is:

1. An electron tube including a tubular glass envelope portion having an electrode system slidably supported therein by a plurality of pretensioned metallic spring elements, each of said spring elements having a first end attached to the electrode system and extending angularly therefrom, generally in a direction of insertion of the electrode system into the tubular glass envelope portion, to a second end thereof which slidably presses against an inner wall surface of the envelope portion;

characterized in that the first end of each of the spring elements is affixed to the electrode system at a first point, the second end of each of said spring elements slidably contacts the inner wall surface at a second point, and each of said spring elements is shaped such that:

1) in a relaxed state, before insertion into the envelope portion, an effective length of said spring element extending from the first point to the second point has a predefined curve including at least one bend and arcuate portion on each side of said bend for establishing a predetermined normal force $F_r$ at the second point, perpendicular to the inner wall surface, when in the pretensioned state; and 2) in the pretensioned state, after insertion into the envelope portion, said spring element is centered substantially along a straight line over its effective length;

said shape ensuring that the normal force $F_r$, acting through the second point against pressure applied by the spring element, and a frictional force $F_f$, acting against a force applied to cause sliding of the second end along said inner wall surface, collectively produce a resultant force acting along the effective length of the spring element and having substantially no component acting perpendicularly to said effective length, thereby substantially preventing flexing of the spring element during insertion of the electrode system into the envelope portion.

2. An electron tube including a tubular glass envelope portion having an electrode system slidably supported therein by a plurality of pretensioned metallic spring elements, each of said spring elements having a first end attached to the electrode system and extending angularly therefrom, generally in a direction of insertion of the electrode system into the tubular glass envelope portion, to a second end thereof which slidably presses against an inner wall surface of the envelope portion;

characterized in that the first end of each of the spring elements is affixed to the electrode system at a first point, the second end of each of said spring elements slidably contacts the inner wall surface at a second point and, at least where it presses against the inner wall surface, compresses a layer of material having a lower hardness than the hardness of the material forming the spring element itself, and each of said spring elements is shaped such that:

1) in a relaxed state, before insertion into the envelope portion, an effective length of said spring element extending from the first point to the second point has a predefined curve for establishing a predetermined normal force $F_r$ at the second point, perpendicular to the inner wall surface, when in the pretensioned state; and 2) in the pretensioned state, after insertion into the envelope portion, said spring element is centered substantially along a straight line over its effective length;

said shape ensuring that the normal force $F_r$, acting through the second point against pressure applied by the spring element, and a frictional force $F_f$, acting against a force applied to cause sliding of the second end along said inner wall surface, collectively produce a resultant force acting along the effective length of the spring element and having substantially no component acting perpendicularly to said effective length, thereby substantially preventing flexing of the spring element during insertion of the electrode system into the envelope portion.

3. An electron tube as in claim 2 where said layer consists essentially of a copper-nickel alloy and where the spring element consists essentially of chromium-nickel steel.

4. An electron tube including a tubular glass envelope portion having an electrode system slidably supported therein by a plurality of pretensioned metallic spring elements, each f said spring elements having a first end attached to the electrode system and extending angularly therefrom, generally in a direction of insertion of the electrode system into the tubular glass envelope portion, to a second end thereof which slidably presses against an inner wall surface of the envelope portion;

characterized int hat the first end of each of the spring elements is affixed to the electrode system at a first point, the second end of each of said spring elements slidably contacts the inner wall surface at a second point and, at lest where it presses against the inner wall surface, is chemically roughened, and each of said spring elements is shaped such that:

1) in a relaxed state, before insertion into the envelope portion, an effective length of said spring element extending from the first point to the second point has a predefined curve for establishing a predetermined normal force $F_r$ at the second point, perpendicular to the inner wall surface, when in the pretensioned state; and 2) in the pretensioned state, after insertion into the envelope portion, said spring element is centered substantially along a straight line over its effective length;

said shape ensuring that the normal force $F_r$, acting through the second point against pressure applied by the spring element, and a frictional force $F_f$, acting against a force applied to cause sliding of the second end along said inner wall surface, collectively produce a resultant force acting along the effective length of the spring element and having substantially no component acting perpendicularly to said effective length, thereby substantially preventing flexing of the spring element during insertion of the electrode system into the envelope portion.

5. An electron tube including a tubular glass envelope portion having an electrode system slidably supported therein by a plurality of pretensioned metallic spring elements, each of said spring elements having a first end attached to the electrode system and extending angularly therefrom, generally in a direction of insertion of the electrode system into the tubular glass envelope portion, to a second end thereof which slidably presses against an inner wall surface of the envelope portion;

characterized in that the first end of each of the spring elements is affixed to the electrode system at a first point, the second end of each of said spring elements slidably contacts the inner wall surface at a second point, and each of the spring elements is shaped to prevent flexing of said spring element during insertion of the electrode system into the envelope portion, each of said spring elements having an effective length extending form the first point to the second point which:

1) in a relaxed state, before insertion into the envelope portion, has a predefined non-linear form including at least one bend and an arcuate portion on each side of said bend for establishing, after insertion when in the pretensioned state, a linear form and a predetermined normal force $F_r$ perpendicular to the inner wall surface at the second point; and 2) in the pretensioned state, after insertion into the envelope portion, has said linear form whereby said effective length is centered substantially along a straight line;

said linear form ensuring that the normal force $F_r$, acting through the second point against pressure applied by the spring element, and a frictional force $F_f$, acting in a direction opposite to a force applied to cause sliding of the second end along said inner wall surface, collectively produce a resultant force acting along the effective length of the spring element and having substantially no component acting perpendicularly to said effective length.

6. An electron tube including a tubular glass envelope portion having an electrode system slidably supported therein by a plurality of pretensioned metallic spring elements, each of said spring elements having a first end attached to the electrode system and extending angularly therefrom, generally in a direction of insertion of the electrode system into the tubular glass envelope portion, to a second end thereof which slidably presses against an inner wall surface of the envelope portion;

characterized in that the first end of each of the spring elements is affixed to the electrode system at a first point, the second end of each of said spring elements slidably contacts the inner wall surface at a second point and, at least where it presses against the inner wall surface, comprises a layer of material having a lower hardness than the hardness of the material forming the spring element itself, and each of the spring elements is shaped to prevent flexing of said spring element during insertion of the electrode system into the envelope portion, each of said spring elements having an effective length extending from the first point to the second point which:

1) in a relaxed state, before insertion into the envelope portion, has a predefined non-linear form for establishing, after insertion when in the pretensioned state, a linear form and a predetermined normal force $F_r$ perpendicular to the inner wall surface at the second point; and 2) in the pretensioned state, after insertion into the envelope portion, has said linear form whereby said effective length is centered substantially along a straight line;

said linear form ensuring that the normal force $F_r$, acting through the second point against pressure applied by the spring element, and a frictional force $F_f$, acting in a direction opposite to a force applied to cause sliding of the second end along said inner wall surface, collectively produce a resultant force acting along the effective length of the spring element and having substantially no component acting perpendicularly to said effective length.

7. An electron tube as in claim 6 where said layer consists essentially of a copper-nickel alloy and where the spring element consists essentially of chromium-nickel steel.

8. An electron tube including a tubular glass envelope portion having an electrode system slidably supported therein by a plurality of pretensioned metallic spring elements, each of said spring elements having a first end attached to the electrode system and extending angularly therefrom, generally in a direction of insertion of the electrode system into the tubular glass envelope portion, to a second end thereof which slidably presses against an inner wall surface of the envelope portion;

characterized in that the first end of each of the spring elements is affixed to the electrode system at a first point, the second end of each of said spring elements slidably contacts the inner wall surface at a second point and, at least where it presses against the inner wall surface, is chemically roughened, and each of the spring elements is shaped to prevent flexing of said spring element during insertion of the electrode system into the envelope portion, each of said spring elements having an effective length extending from the first point to the second point which:

1) in a relaxed state, before insertion into the envelope portion, has a predefined non-linear form for establishing, after insertion when in the pretensioned state, a linear form and a predetermined normal force $F_r$ perpendicular to the inner wall surface at the second point; and 2) in the pretensioned state, after insertion into the envelope portion, has said linear form whereby said effective length is centered substantially along a straight line;

said shape form ensuring that the normal force $F_r$, acting through the second point against pressure applied by the spring element, and a frictional force $F_f$, acting in a direct opposite to a force applied to cause sliding of the second end along said inner wall surface, collectively produce a resultant force acting along the effective length of the spring element and having substantially no component acting perpendicularly to said effective length.

9. An electron tube including a tubular glass envelope portion having an electrode system slidably supported therein by a plurality of pretensioned metallic spring elements, each of said spring elements having a first end attached to the electrode system and extending angularly therefrom, generally in a direction of insertion of the electrode system into the tubular glass envelope portion, to a second end thereof which slidably presses against an inner wall surface of the envelope portion;

characterized in that the first end of each of the spring elements is affixed to the electrode system at a first point, the second end of each of said spring elements slidably contacts the inner wall surface at a second point, and each of said spring elements is shaped such that:

a) in a relaxed state, before insertion into the envelope portion, said spring element has a predefined shape including at least one bend and an arcuate portion on each side of said bend for establishing a predetermined normal force $F_r$ at the second point, perpendicular to the inner wall surface, when in the pretensioned state; and b) in the pretensioned state, after insertion into the envelope portion, an affective length of said spring element extending from the first point to the second point is centered substantially along a straight line over its effective length;

said shape form ensuring that the normal force $F_r$, acting through the second point against pressure applied by the spring element, and a frictional force $F_f$, acting in a direction opposite to said direction of insertion, collectively produce a resultant force acting substantially along the effective length of the spring element and having substantially no component acting perpendicularly to said effective length.

10. An electron tube including a tubular glass envelope portion having an electrode system slidably supported therein by a plurality of pretensioned metallic spring elements, each of said spring elements having a first end attached to the electrode system and extending angularly therefrom, generally in a direction of insertion of the electrode system into the tubular glass envelope portion, to a second end thereof which slidably presses against an inner wall surface of the envelope portion;

characterized in that the first end of each of the spring elements is affixed to the electrode system at a first point, the second end of each of said spring elements slidably contacts the inner wall surface at a second point and, at least where it presses against the inner wall surface, comprises a layer of material having a lower hardness than the hardness of the material forming the spring element itself, and each of said spring elements is shaped such that:

a) in a relaxed state, before insertion into the envelope portion, said spring element has a predefined shape for establishing a predetermined normal force $F_r$ at the second point, perpendicular to the inner wall surface, when in the pretensioned state; and b) in the pretensioned state, after insertion into the envelope portion, an effective length of said spring element extending from the first point of the second point is centered substantially along a straight line over its effective length;

said shape ensuring that the normal force $F_r$, acting through the second point against pressure applied by the spring element, and a friction force $F_f$, acting in a direction opposite to said direction of insertion, collectively produce a resultant force acting substantially along the effective length of the spring element and having substantially no component acting perpendicularly to said effective length.

11. An electron tube as in claim 10 where said layer consists essentially of a copper-nickel alloy and where the spring element consists essentially of chromium-nickel steel.

12. An electron tube including a tubular glass envelope portion having an electrode system slidably supported therein by a plurality of pretensioned metallic spring elements, each of said spring element having a first end attached to the electrode system and extending angularly therefrom, generally in a direction of insertion of the electrode system into the tubular glass envelope portion, to a second end thereof which slidably presses against an inner wall surface of the envelope portion;

characterized in that the first end of each of the spring elements is affixed to the electrode system at a first point, the second end of each of said spring elements slidably contacts the inner wall surface at a second point and, at least where it presses against the inner wall surface, is chemically roughened, and each of said spring elements is shaped such that:

a) in a relaxed state, before insertion into the envelope portion, said spring element has a predefined shape, for establishing a predetermined normal force $F_r$ at the second point, perpendicular to the inner wall surface, when in the pretensioned state; and b) in the pretensioned state, after insertion into the envelope portion, an effective length of said spring element extending from the first point other second point is centered substantially along a straight line over its effective length;

said shape ensuring that the normal force $F_r$, acting through the second point against pressure applied by the spring element, and a friction force $F_f$, acting in a direction opposite to said direction of insertion, collectively produce a resultant force acting substantially along the effective length of the spring element and having substantially no component acting perpendicularly to said effective length.

* * * * *